United States Patent [19]

Strawczynski et al.

[11] 4,410,763

[45] Oct. 18, 1983

[54] SPEECH DETECTOR

[75] Inventors: Leo Strawczynski, Ottawa; Hing-Fai Lee, Nepean, both of Canada

[73] Assignee: Northern Telecom Limited, Montreal, Canada

[21] Appl. No.: 271,971

[22] Filed: Jun. 9, 1981

[51] Int. Cl.[3] ..... G10L 1/00

[52] U.S. Cl. ..... 364/513.5; 179/1.1

[58] Field of Search ..... 179/1 SC, 1 VC, 1 P; 364/513; 370/81; 455/222, 221

[56] References Cited

U.S. PATENT DOCUMENTS

| | | | |
|---|---|---|---|
| 4,008,375 | 2/1977 | Lanier | 179/1 VC |
| 4,028,496 | 6/1977 | La Marche | 179/1 SC |
| 4,052,568 | 10/1977 | Jankowski | 179/15 AS |
| 4,277,645 | 7/1981 | May | 179/1 SC |

*Primary Examiner*—Emanuel S. Kemeny
*Attorney, Agent, or Firm*—R. John Haley

[57] ABSTRACT

Samples of a transmit path voice channel signal are averaged and compared with an adaptive speech threshold to determine the presence of speech. When the average falls below a fixed threshold, a timing circuit is triggered to time a delay period followed by a noise averaging period. The timing of these periods is aborted if either the transmit path average, or a similarly produced receive path average, exceeds the fixed threshold during either period. During the averaging period the voice channel signal is averaged, and at the end of this period the average noise level is used to determine the adaptive speech threshold, a predetermined level above the average noise level, the new adaptive speech threshold being stored. The stored adaptive speech threshold is not changed unless the timing of the delay and averaging periods is completed, ensuring that only the noise is averaged to determine the adaptive speech threshold.

15 Claims, 2 Drawing Figures

SPEECH DETECTOR

Figure 1:
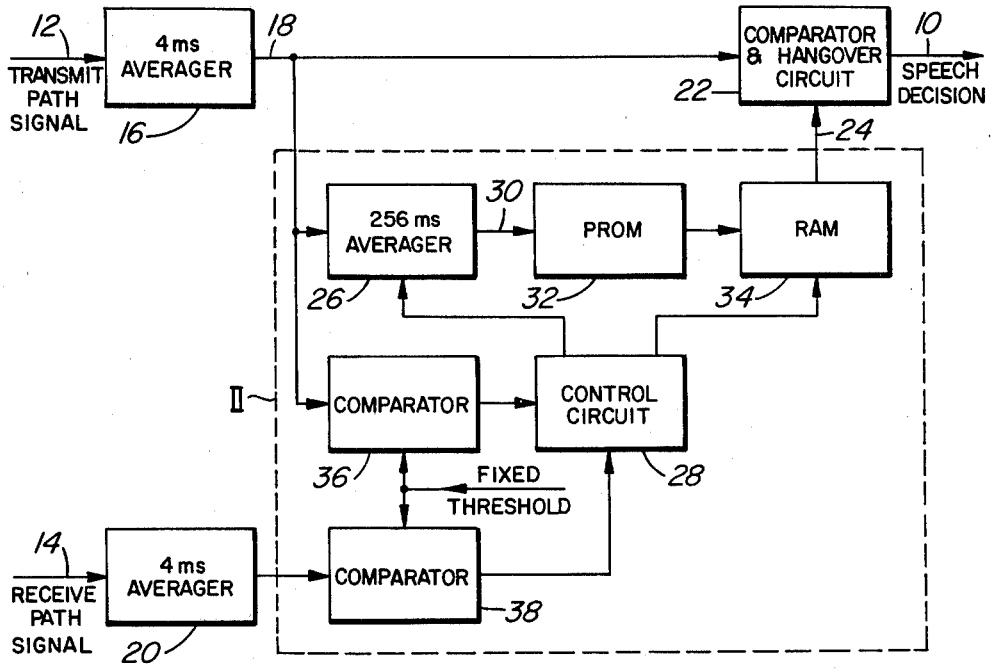

This invention relates to a speech detector for, and to a method of, detecting the presence of speech in a voice channel signal.

Speech detectors are used in a variety of speech transmission systems in which speech transmission paths are established in response to the detection of speech activity on a voice channel. One such system is a TASI (time assignment speech interpolation) system, such as the TASI system described and claimed in U.S. patent application Ser. No. 218,683, filed Sept. 22, 1980, by D. H. A. Black and entitled "TASI System Including an Order Wire."

A speech detector should be highly sensitive to speech signals while remaining insensitive to noise. A difficulty arises in distinguishing, quickly and accurately, between speech signals, particularly at low levels, and noise. In a TASI system, for example, the speech detector should be able to detect low level speech signals in order to avoid excessive speech clipping at the start of speech bursts, but should not respond to noise alone because this would undesirably increase the activity of the TASI system.

Various forms of speech detector have been devised in order to distinguish more effectively between speech signals and noise. For example, Lanier U.S. Pat. No. 4,008,375, issued Feb. 15, 1977, discloses a digital voice switch in which speech signal samples are compared with a variable threshold level which is adapted in dependence upon the noise which is present. To this end, the samples are also compared with a second threshold a fixed amount below the variable threshold level, a counter counts the number of times in a given period that this second threshold is exceeded, and the variable threshold level is decreased if the count is less than a predetermined number in two successive counting periods. Furthermore, the number of times that the samples exceed the variable threshold level in the given period is counted, and the variable threshold level is increased in dependence upon the uniformity of this count for eight successive counting periods. This arrangement is obviously complex and relatively expensive, is slow to respond to changing noise levels, and is subject to result in false indications of speech in response to high noise pulses which may commonly occur.

Some of these disadvantages are reduced by the digital voice switch disclosed in Jankowski U.S. Pat. No. 4,052,568, issued Oct. 4, 1977. In this arrangement, speech signal samples are compared with variable speech and noise threshold levels and with a fixed disabling threshold level. The number of times that the noise threshold is exceeded in a given period is used to adaptively adjust the speech and noise threshold levels, which differ by a fixed amount. When speech has been detected, and for the duration of a speech hangover period, the adaptive adjustment is prevented if the disabling threshold level is exceeded. The disabling threshold level is set relatively high, in order that it is not exceeded by high noise pulses. However, a result of this is that the adaptive adjustment may not be prevented during relatively low level speech signals from a quiet talker, giving rise to maladjustment of the speech and noise threshold levels. Furthermore, this arrangement is still relatively complex and expensive, requiring two variable and one fixed threshold comparators as well as other counting and comparison circuitry.

Accordingly, a need exists to provide an improved speech detector which is relatively simple but still provides an adaptive threshold level for effective speech detection. An object of this invention is to provide such a speech detector, as well as an improved method of detecting the presense of speech in a voice channel signal.

According to one aspect of this invention there is provided a speech detector for detecting the presence of speech in a voice channel signal, comprising: means for producing a control signal in response to the voice channel signal falling below a first speech threshold; means responsive to the control signal for determining a noise level of the voice channel signal while the voice channel signal is below the first speech threshold; means for determining a second speech threshold in dependence upon the determined noise level; and means for indicating the presence of speech in response to the voice channel signal exceeding the second speech threshold.

Thus in contrast to the prior art discussed above, in a speech detector in accordance with this invention the noise level can only be determined when no speech is present, i.e. when the voice channel signal is below the first speech threshold.

The means for producing the control signal conveniently comprises means for comparing the voice channel signal with the first speech threshold and means for producing the control signal in response to a change in the comparison result. Most conveniently the first speech threshold is a fixed threshold, the voice channel signal is a digital signal comprising a plurality of bits, and the means for comparing comprises a gating circuit to which a plurality of said bits are supplied.

Preferably the means for determining the noise level comprises means responsive to the control signal for determining a predetermined delay period, and means for determining the noise level at the end of the delay period. The latter means conveniently comprises means for averaging the level of the voice channel signal during a predetermined averaging period commencing at the end of the delay period.

The means for determining the noise level preferably comprises means for inhibiting the determination of the noise level if the voice channel signal exceeds the first speech threshold during said delay period or during said averaging period. The speech detector preferably further comprises means for inhibiting the determination of the noise level if during said delay period or during said averaging period the level of a voice channel signal, in the opposite direction of transmission from that of the voice channel signal in which the presense of speech is to be detected, exceeds a third speech threshold. Thus echoes of speech signals on a receive path, which may occur in the voice channel signal but may be insufficient to exceed the first speech threshold, can not disturb the correct noise level determination. The first and third speech thresholds can be the same or different.

In order that the adaptive second speech threshold is not exceeded by high short-duration noise pulses which may occur in the voice channel and which could give rise to a false indication that speech is present, preferably the voice channel signal is an averaged signal, the speech detector including means for averaging individual voice channel signal samples to produce the averaged voice channel signal.

According to another aspect this invention provides a speech detector for detecting the presence of speech in digital signal samples on a transmit path of a voice channel also having digital signal samples on a receive path, the speech detector comprising: means for averaging the transmit path digital signal samples over a predetermined period to produce a transmit path average digital signal; means for averaging the receive path digital signal samples over a predetermined period to produce a receive path average digital signal; means for producing a timing trigger signal in response to the transmit path average digital signal falling below a speech threshold; means for producing a timing abort signal in response to either the transmit path average digital signal exceeding said speech threshold or the receive path average digital signal exceeding a speech threshold; timing means responsive to the timing trigger signal to time a predetermined delay period and an immediately following predetermined averaging period and responsive to the timing abort signal to abort said timing; means for producing an average noise level of the transmit path digital signal samples during each predetermined averaging period timed by said timing means; means for determining an adaptive digital speech threshold a predetermined level above said average noise level; means for storing the determined adaptive digital speech threshold at the end of each predetermined averaging period timed by said timing means; and digital comparator means for comparing the transmit path average digital signal with the stored adaptive digital speech threshold and indicating the presence of speech in response to the average signal exceeding the adaptive threshold.

The invention also extends to a method of detecting the presence of speech in a voice channel signal, comprising the steps of: determining a noise level of the voice channel signal in response to the voice channel signal falling below, and remaining below, a first speech threshold; determining and storing a second speech threshold a predetermined level above the determined noise level; and comparing the voice channel signal with the second speech threshold and indicating that speech is present in response to the voice channel signal exceeding the second speech threshold.

Figure 2:
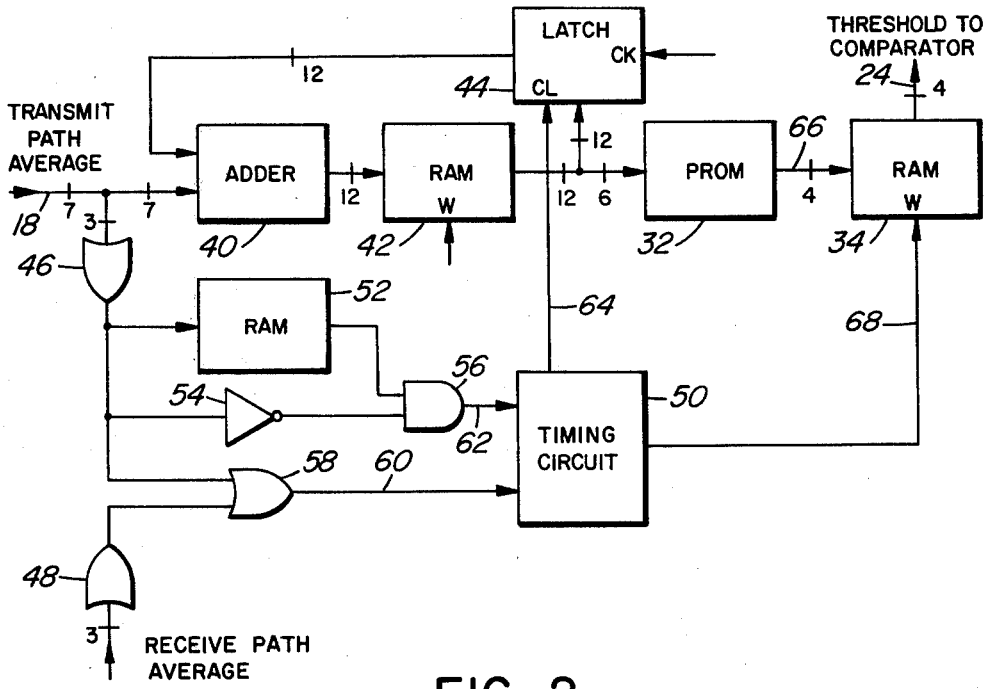

The invention will be further understood from the following description with reference to the accompanying drawings, in which:

FIG. 1 shows a block diagram of a speech detector in accordance with the invention; and FIG. 2 illustrates in more detail parts of the speech detector shown within a dashed line box II in FIG. 1.

The speech detector shown in FIG. 1 serves for producing a speech decision on an output line 10 in response to speech being present in a voice channel signal, referred to herein as the transmit path signal and present on a line 12. The speech detector is for example for use in a TASI system such as that described in the patent application by D. H. A. Black already referred to. It is assumed here that, as is typical in such a system, the voice channel signal is an 8-bit digital signal sample, the voice channel signal being sampled at a frequency of 8 kHz.

In addition to the transmit path signal, in a bidirectional transmission system such as a TASI system there is a voice channel signal for the opposite direction of transmission. This is referred to herein as the receive path signal and is present on a line 14. The reason for supplying the receive path signal, which is also assumed to be an 8 -bit digital signal sampled at a frequency of 8kHz, to the speech detector will become clear from the following description.

In order to reduce triggering of the speech decision by high level noise pulses which commonly occur in the transmit path signal, the magnitudes of the signal samples are averaged over a period of 4 ms by an averager 16, which produces on a line 18 an averaged transmit path signal magnitude every 4 ms. The period of 4 ms is not critical, but is selected for convenience and simplicity of the averaging circuitry. Similarly, the receive path signal sample magnitudes are averaged over 4 ms periods by an averager 20. The averagers 16 and 20 have a similar form to an averager 26 described in detail below, except that they are supplied with different timing signals and have a division factor of 32. Accordingly the averagers 16 and 20 are not described in further detail here.

The averaged magnitude on the line 18, this being a 7-bit digital singal, is compared in a comparator and hangover circuit 22 with an adaptive digital threshold supplied on a line 24 and produced as described below. The circuit 22 comprises a digital comparator and a timing circuit which is responsive to the comparator output to produce the speech decision on the line 10 when the magnitude on the line 18 exceeds the threshold on the line 24 and for a following hangover period. The circuit 22 can be of a known form and accordingly is not further described here.

The adaptive threshold is produced on the line 24 by circuitry within a dashed line box II and which is shown in more detail in FIG. 2. This circuitry includes the averager 26, which is supplied with the averaged transmit path signal magnitude from the line 18 and serves to produce, under the control of a control circuit 28, an average of the noise level of the transmit path signal, this average being taken over a period of 256 ms. Again, this period is not critical but is selected for convenience. The average noise level, produced on a line 30, is used to address a PROM (programmable read only memory) 32 to read out to a RAM (random access memory) 34 a threshold which is a fixed level, for example 3 dB, above the average noise level. The PROM 32 is used here, rather than an adder, because the transmit path signal is typically a non-linearly encoded signal. The threshold from the PROM 32 is stored in the RAM 34 under the control of the control circuit 28, and is read from the RAM 34 to constitute the adaptive threshold on the line 24.

In order to ensure that the averager 26 only averages noise in the transmit path signal, and that no speech signals are included which would affect the averaging process and result in an unduly high threshold, the control circuit 28 is controlled by comparators 36 and 38 which compare the average transmit and receive the path signal magnitudes, respectively, with a fixed threshold of for example −40 dBmO. In response to the output of the comparator 36 changing in response to the average on the line 18 falling below the fixed threshold, a timer in the control circuit 28 is started. After a predetermined delay period, for example 256 ms, timed by the timer the control circuit enables the averager 26 to start the averaging process. At the end of the 256 ms averaging period, also timed by the timer, the control circuit enables the threshold produced by the PROM 32 to be stored in the RAM 34, so that the threshold in the RAM 34 is updated, or adapted, in accordance with the prevailing noise level of the transmit path signal. However, if either of the comparators 36 and 38 produces, during these timing periods, an output which represents that either the transmit path or the receive path average exceeds the fixed threshold, then the timing and averaging are aborted and the threshold stored in the RAM 34 is not changed.

Thus the noise level averaging process is not started until a certain time after the transmit path signal average has fallen below the fixed threshold, to ensure that no speech signal is present at the start of the noise level averaging. If speech subsequently occurs in the transmit path signal, the noise level averaging is inhibited. Similarly, if speech occurs in the receive path signal the noise level averaging is inhibited, because speech in the receive path signal generally produces some echo in the transmit path signal. Such echo may not be sufficiently great as to cause the average on the line 18 to exceed the fixed threshold, but nevertheless can be sufficient to adversely affect the noise level averaging.

Accordingly, the arrangement of the comparators 36 and 38 and the control circuit 28 ensures that noise level averaging takes place only when no speech is present, so that a reliable and accurate noise level measurement is obtained, so that the adaptive threshold is also reliably and accurately determined.

Referring to FIG. 2, the averager 26 is constituted by a 12-bit adder 40, a RAM 42, and a latch 44; the comparators 36 and 38 are constituted by OR gates 46 and 48 respectively, and the control circuit 28 is constituted by a timing circuit 50, a RAM 52, an inverter 54, an AND gate 56, and an OR gate 58. FIG. 2 also shows the PROM 32 and the RAM 34.

The fixed threshold of −40 dBmO corresponds to the 7-bit digital value 0001111. Accordingly, this threshold is exceeded if any of the three most significant bits of the 7-bit average on the line 18 is a logic 1. The three most significant bits of the average on the line 18 are supplied to inuts of the OR gate 46, whose output is a logic 1 if the threshold is exceeded. Similarly, the three most significant bits of the receive path average from the averager 20 are supplied to inputs of the OR gate 48, whose output is a logic 1 if the threshold is exceeded. The outputs of the gates 46 and 48 are combined in the OR gate 58, whose output signal on a line 60 is supplied to the timing circuit to inhibit or abort the timing process when speech is present in either of the receive and transmit paths.

The output of the gate 46 is also supplied to the RAM 52, which is controlled in known manner by timing means not shown to delay this output by 4 ms, i.e. until the output from the gate 46 is available in respect of the next transmit path average. The current output of the gate 46, inverted by the inverter 54, and the delayed previous output of the gate 46 are supplied to the inputs of the gate 56, whose output is a logic 1 trigger signal only in response to the gate 46 output changing from 1 to 0 for successive transmit path averages. Thus this trigger signal is produced on a line 62 in response to the transmit path signal average falling below the fixed threshold.

The trigger signal on the line 62 is supplied to the timing circuit 50 and, assuming that the abort signal on the line 60 is a logic 0 and does not change, triggers the timing circuit 50 to commence timing a period of 256 ms. At the end of this period the timing circuit 50 starts to time another period of 256 ms, this being the averaging period. During the averaging period, every 4 ms the latch 44 is clocked by a timing signal supplied to its clock input CK to store a 12-bit accumulated average from the RAM 42, the current transmit path average is added to this by the adder 40, and the resultant new accumulated average is written into the RAM 42 by a timing signal applied to its write input W. At the start of the averaging period the timing circuit 50 supplies a signal via a line 64 to a clear input CL of the latch 44, so that initially the accumulated average is zero.

At the end of the averaging period the 6 most significant bits of the 12-bit accumulated average in the RAM 42, which equal the accumulated average divided by 64, constitute a true average noise level of the transmit path signal. These 6 bits are used to address the PROM 32 to read out to a line 66 the desired, for example 4-bit, adaptive threshold a fixed amount above the average noise level. The threshold on the line 66 is stored in the RAM 34 in response to a write signal which the timing circuit 50 produces at the end of the averaging period and which is supplied via a line 68 to a write input W of the RAM 34. Consequently, the newly updated stored threshold is subsequently supplied to the line 24.

If during the timing of either 256 ms period the signal on the line 60 becomes a logic 1, the timing is aborted and no write signal is produced on the line 68, so that the threshold stored in the RAM 34 is not changed. The timing processes described above are then started again in response to the next logic 1 trigger signal on the line 62 with a logic 0 abort signal on the line 60.

As described above, in operation of the speech detector the average noise level of the voice channel is determined. It should be appreciated that, in a TASI system, this average noise level can also be transmitted to the far end where it can be used to adaptively adjust the level of a locally generated noise signal which in known manner is inserted during disconnected periods of the voice channel in order to reduce noise signal contrast.

Although the speech detector has been described above in relation to a single voice channel signal, as is known in the art the speech detector can be operated in a multiplexed manner to detect speech in a plurality of voice channel signals. To this end the RAMs 34, 42, and 52 and the timing circuit 50, and similarly RAMs in the averagers 16 and 20 and the timing circuits in the comparator and hangover circuit 22, are conveniently addressed with address signals identifying each channel in turn in a time division multiplexed manner. Accordingly, the described speech detector can operate in all respects contemporaneously in respect of a plurality of voice channels.

Numerous other changes may be made in the speech detector described above. For example, the averaging and comparison of the receive path signal could be dispensed with, the trigger and abort signals being produced solely in dependence on the transmit path signal. Furthermore, the averaging periods, the delay period between the occurrence of the trigger signal and the start of the noise level averaging period, the fixed thresholds, and the difference between the adaptive threshold and the monitored noise level, produced in the PROM 32, may all be varied from the values given above. The manners of effecting the averaging, monitoring the noise level, and timing may also be different from those described. Accordingly, numerous variations, modifications, and adaptations may be made to the embodiment of the invention described above without departing from the scope of the invention, as defined in the claims.

What is claimed is:

1. A speech detector for detecting the presence of speech in a voice channel signal, comprising:

means for producing a control signal in response to the voice channel signal falling below a first speech threshold;

means responsive to the control signal for determining a noise level of the voice channel signal while the voice channel signal is below the first speech threshold;

means for determining a second speech threshold in dependence upon the determined noise level; and means for indicating the presence of speech in response to the voice channel signal exceeding the second speech threshold.

2. A speech detector as claimed in claim 1 wherein the means for producing the control signal comprises means for comparing the voice channel signal with the first speech threshold and means for producing the control signal in response to a change in the comparison result.

3. A speech detector as claimed in claim 2 wherein the first speech threshold is a fixed threshold, the voice channel signal is a digital signal comprising a plurality of bits, and the means for comparing comprises a gating circuit to which a plurality of said bits are supplied.

4. A speech detector as claimed in claim 2 wherein the voice channel signal is a periodically occurring signal, and the means for producing the control signal comprises means for storing the comparison result in respect of each periodically occurring voice channel signal until the next comparison result is produced, and logic means for producing the control signal in dependence upon successive comparison results.

5. A speech detector as claimed in claim 1 wherein the means for determining the noise level comprises means responsive to the control signal for determining a predetermined delay period, and means for determining the noise level at the end of the delay period.

6. A speech detector as claimed in claim 5 wherein the means for determining the noise level at the end of the delay period comprises means for averaging the level of the voice channel signal during a predetermined averaging period commencing at the end of the delay period.

7. A speech detector as claimed in claim 6 wherein the means for determining the noise level comprises means for inhibiting the determination of the noise level if the voice channel signal exceeds the first speech threshold during said delay period or during said averaging period.

8. A speech detector as claimed in claim 7 and further comprising means for inhibiting the determination of the noise level if during said delay period or during said averaging period the level of a voice channel signal, in the opposite direction of transmission from that of the voice channel signal in which the presence of speech is to be detected, exceeds a third speech threshold.

9. A speech detector as claimed in claim 8 wherein the third speech threshold is the same as the first speech threshold.

10. A speech detector as claimed in claim 1 wherein the means for determining the second speech threshold is arranged to determine the second speech threshold a predetermined level above the determined noise level.

11. A speech detector as claimed in claim 10 wherein the means for determining the second speech threshold comprises a programmable read only memory which is responsive to the determined noise level to produce the second speech threshold, and means for storing the second speech threshold produced in response to the determined noise level.

12. A speech detector as claimed in claim 3 wherein the means for indicating the presence of speech comprises a digital comparator for comparing the voice channel signal with the second speech threshold.

13. A speech detector as claimed in claim 1, 4, or 8 wherein the voice channel signal is an averaged signal, the speech detector including means for averaging individual voice channel signal samples to produce the averaged voice channel signal.

14. A speech detector for detecting the presence of speech in digital signal samples on a transmit path of a voice channel also having digital signal samples on a receive path, the speech detector comprising:

means for averaging the transmit path digital signal samples over a predetermined period to produce a transmit path average digital signal;

means for averaging the receive path digital signal samples over a predetermined period to produce a receive path average digital signal;

means for producing a timing trigger signal in response to the transmit path average digital signal falling below a speech threshold;

means for producing a timing abort signal in response to either the transmit path average digital signal exceeding said speech threshold or the receive path average digital signal exceeding a speech threshold;

timing means responsive to the timing trigger signal to time a predetermined delay period and an immediately following predetermined averaging period, and responsive to the timing abort signal to abort said timing;

means for producing an average noise level or the transmit path digital signal samples during each predetermined averaging period timed by said timing means;

means for determining an adaptive digital speech threshold a predetermined level above said average noise level;

means for storing the determined adaptive digital speech threshold at the end of each predetermined averaging period timed by said timing means; and digital comparator means for comparing the transmit path average digital signal with the stored adaptive speech threshold and indicating the presence of speech in response to the average signal exceeding the adaptive threshold.

15. A method of detecting the presence of speech in a voice channel signal, comprising the steps of:

determining a noise level of the voice channel signal in response to the voice channel signal falling below, and remaining below, a first speech threshold;

determining and storing a second speech threshold a predetermined level above the determined noise level; and comparing the voice channel signal with the second speech threshold and indicating that speech is present in response to the voice channel signal exceeding the second speech threshold.

* * * * *